United States Patent [19]

Bastide

[11] 3,938,759

[45] Feb. 17, 1976

[54] SPECIAL AIRCRAFT USING A NOVEL INTEGRATED LIFT, PROPULSION AND STEERING SYSTEM

[76] Inventor: Paul Bastide, 108, rue de Rennes, 75006-Paris, France

[22] Filed: Aug. 19, 1974

[21] Appl. No.: 498,873

Related U.S. Application Data

[62] Division of Ser. No. 354,797, April 26, 1973, abandoned.

[30] Foreign Application Priority Data

Apr. 26, 1972 France ..... 72.14768

[52] U.S. Cl. ..... 244/9; 244/20

[51] Int. Cl.[2] ..... B64C 39/00

[58] Field of Search ..... 244/9, 10, 19, 20, 21, 244/27, 50, 55, 12, 70; 416/111, 108, 109, 110; 115/52, 50

[56] References Cited

UNITED STATES PATENTS

| | | | |
|---|---|---|---|
| 1,754,977 | 4/1930 | Bergman | 244/20 |
| 1,922,606 | 8/1933 | Voith | 115/50 |
| 2,090,052 | 8/1937 | Kirsten | 244/20 |
| 2,413,460 | 12/1946 | Main | 244/9 |
| 2,580,428 | 1/1952 | Heuver | 416/111 |
| 3,165,280 | 1/1965 | Lee | 244/12 A |
| 3,704,961 | 12/1972 | Fork et al. | 416/111 |

FOREIGN PATENTS OR APPLICATIONS

| | | | |
|---|---|---|---|
| 10,961 | 6/1908 | United Kingdom | 244/20 |
| 16,494 | 7/1914 | United Kingdom | 244/19 |
| 480,750 | 2/1938 | United Kingdom | 244/19 |
| 577,958 | 6/1946 | United Kingdom | 244/20 |
| 1,349,504 | 12/1963 | France | 244/9 |

*Primary Examiner*—Trygve M. Blix
*Assistant Examiner*—Galen L. Barefoot
*Attorney, Agent, or Firm*—Haseltine, Lake & Waters

[57] ABSTRACT

An aircraft having a body on which is mounted an integrated lift, propulsion and steeing system inclusive of cycloidal propellers having horizontal axes of rotation capable of developing net thrust forces at any given angle in a vertical plane. Each propeller is externally driven and is formed with a circular array of blades at the periphery of a common rim and the blades can be turned to vary the angle of thrust by operation of a common control head.

10 Claims, 14 Drawing Figures

Z
$P_2=4P_2$
$P_2$
$P_1$
P
$R_1$
O
G
X
$P_1=4P_1$
Y
π

Z
X
Y
O
G
20'
21'
22'
23'
6-6'
5-5'
20
21
22
23
37
38
39
40

1
2
28
29
30
31
32
33
34
35-35'
36

156
160
161
162
157
166
167
168
169
165
z
x
y

SPECIAL AIRCRAFT USING A NOVEL INTEGRATED LIFT, PROPULSION AND STEERING SYSTEM

This application is a division of copending application Ser. No. 354,797 filed Apr. 26, 1973 (now abandoned) and claims the priority of the application filed in France on Apr. 26, 1972. The application is also related to Ser. No. 515,684 filed Oct. 16, 1974 which in turn is a division of application Ser. No. 354,791 filed Apr. 26, 1973 and issued as U.S. Pat. No. 3,865,060.

BRIEF SUMMARY OF THE INVENTION

The present invention relates to a novel type of aircraft intended for practical use similar to that of conventional helicopters, but by different means leading to improved performance.

The invention also relates to a high power aircraft having a double fuselage body, resulting from the connection of the bodies of two aircraft of said novel type.

The production, by means of said methods, of light and fast aircraft of the "flying wing" type, having a more direct and lighter drive means than the former, this aircraft being able to be used as an aerial taxi or the like.

The construction of airships provided with propeller apparatus and which may serve as aerial freight transporters;

And finally, the connection of two aircraft of this type in which one, by its nature, benefits from its own lift ("aerial vessel"); the other aircraft, provided with propeller apparatus, connected to the upper part of the former, being adaptable for towing the former.

To this end, the aircraft according to the invention uses a novel integrated lift, propulsion and steering system constituted by at least one cycloidal propeller having a horizontal axis comprising a flat rim or ring having a horizontal axis, supporting at its periphery a circular array of identical horizontal blades, each free to turn about an axis perpendicular to said ring under the action of a connecting-rod extending parallel to the plane of said ring, all the connecting-rods having a common control head which may be eccentric with respect to the axis of rotation of said propeller.

According to a feature of the invention, the aircraft comprises four cycloidal propellers having horizontal axes, grouped in pairs, one pair being at the front and one pair at the rear of the aircraft.

According to another feature of the invention, the two pairs of front and rear cycloidal propellers are symmetrical with respect to the center of symmetry of the aircraft, the front pair being below the horizontal plane of symmetry of the aircraft, the rear pair being above this plane. The two propellers of the same pair are co-axial and symmetrical with respect to the longitudinal vertical plane of symmetry, all the axes of rotation of the four propellers rotating in the same direction as seen by an observer located laterally with respect to said aircraft.

According to another feature of the invention, in addition to the four cycloidal propellers, the aircraft uses a system of four auxiliary screws having blades which are free to turn and are reversible, with an axis perpendicular to the longitudinal vertical plane of symmetry xoz and suspended by appropriately streamlined cross members inside four flat portions, two on the longitudinal horizontal axis of symmetry ox (at the front and rear) and two on the transverse vertical axis of symmetry oz, at the top and bottom of the aircraft, the two front and rear screws each being able, with the flat support portions associated therewith, to rotate through 90° about the axis ox under the action of two circular hydraulic jacks inside the aircraft, in order to make the thrusts of the two corresponding screws vertical (in an upwards or downwards direction), which may combine with the cycloidal propellers during landing and take-off operations.

The invention also relates to the construction of an aircraft having a double fuselage arrangement resulting from the connection of the bodies of two of the previously described aircraft, as well as the construction of an aircraft of the "flying wing" type, the propulsion of which is ensured by two cycloidal propellers of the same unitary power and both co-axial and horizontal.

BRIEF DESCRIPTION OF THE DRAWING

Embodiments of the invention will be described hereafter, by way of non-limiting example, referring to the accompanying drawings in which.

Figure 11:
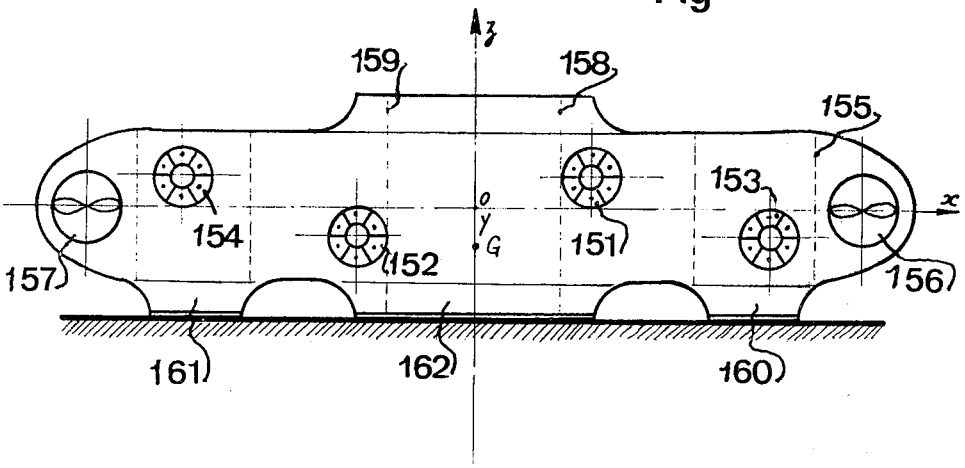
FIG. 11 is a general diagrammatic elevational view as seen from a point located on the Oy axis of an aircraft equipped with two types of propellers and showing.
Figure 12:
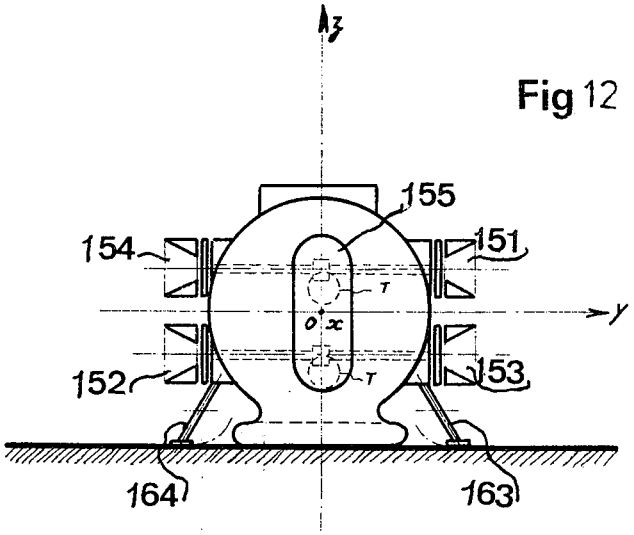
Figures 13, 13A:
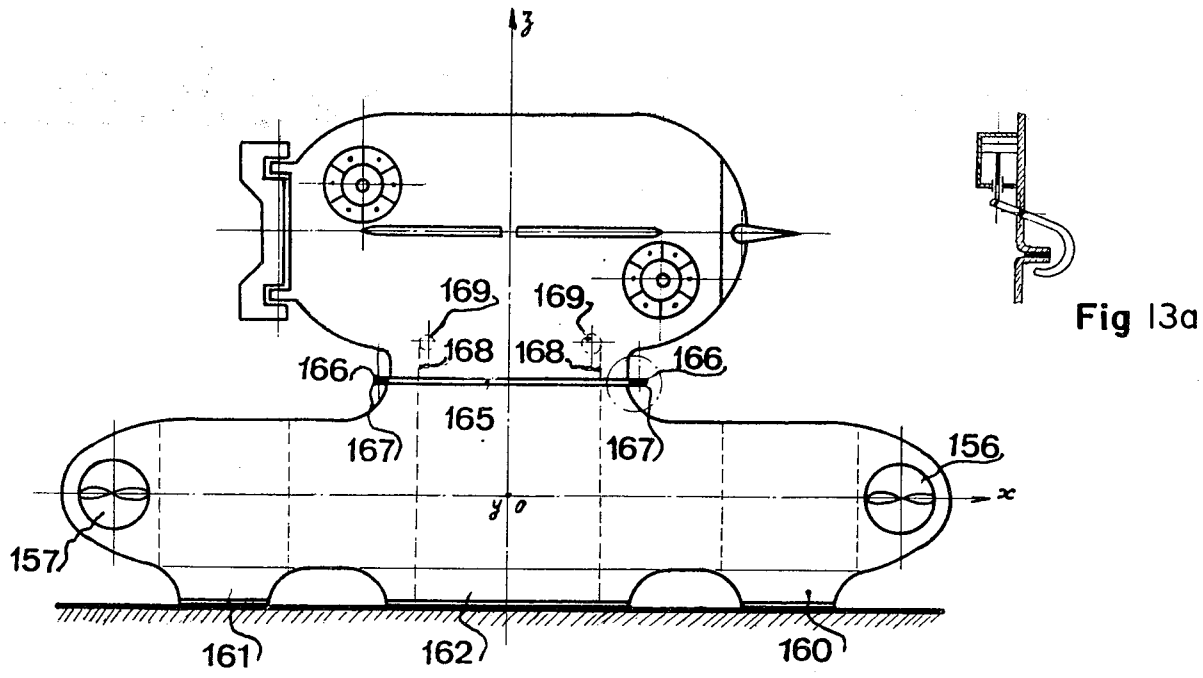

- eight identical cycloidal propellers having a horizontal axis, distributed along the body of the aircraft, four propellers at each side of the aircraft;
- two screw propellers having transverse axes, symmetrical with respect to the plane yoz and perpendicular to the plane xoz and spaces as far as possible from the plane yoz, one at the front, the other at the rear;

FIG. 12 is a diagrammatic cross section through the plane yoz of the aircraft of FIG. 11, FIG. 13 is a diagrammatic side elevational view from a point located on the axis Oy of an "inert" aircraft, i.e. not equipped with its own propellers ("aerial vessel"), but capable of being towed in all possible directions by a special aircraft equipped with propellers and able to be rigidly connected at its lower part to the upper part of the inert aircraft, and FIG. 13*a* is an enlargement of a detail of FIG. 13 according to a modified arrangement.

DETAILED DESCRIPTION

Figure 1:
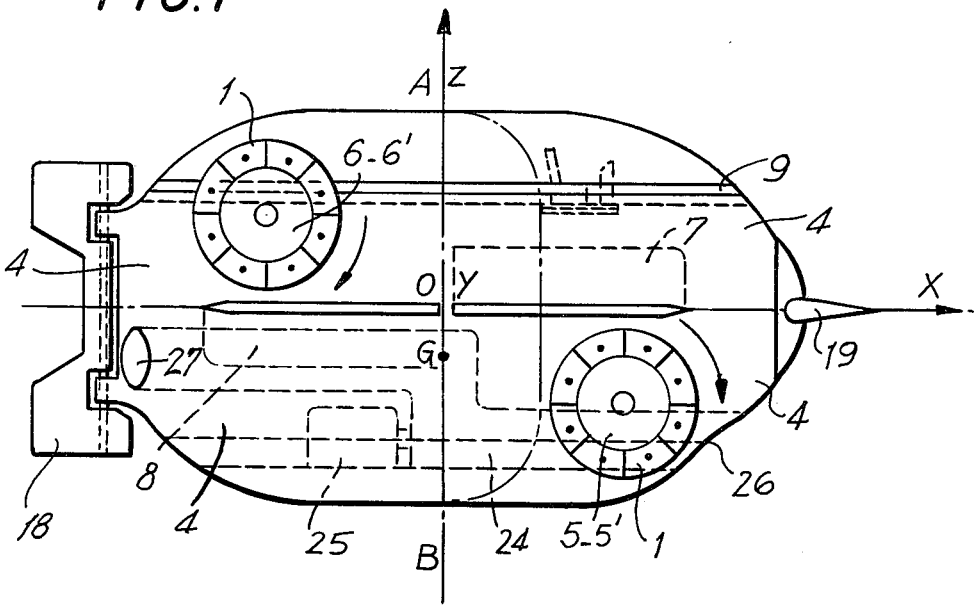
FIG. 1 is a side elevational view of an aircraft in which two pairs of front and rear lift propellers are staggered in height.
Figure 2:
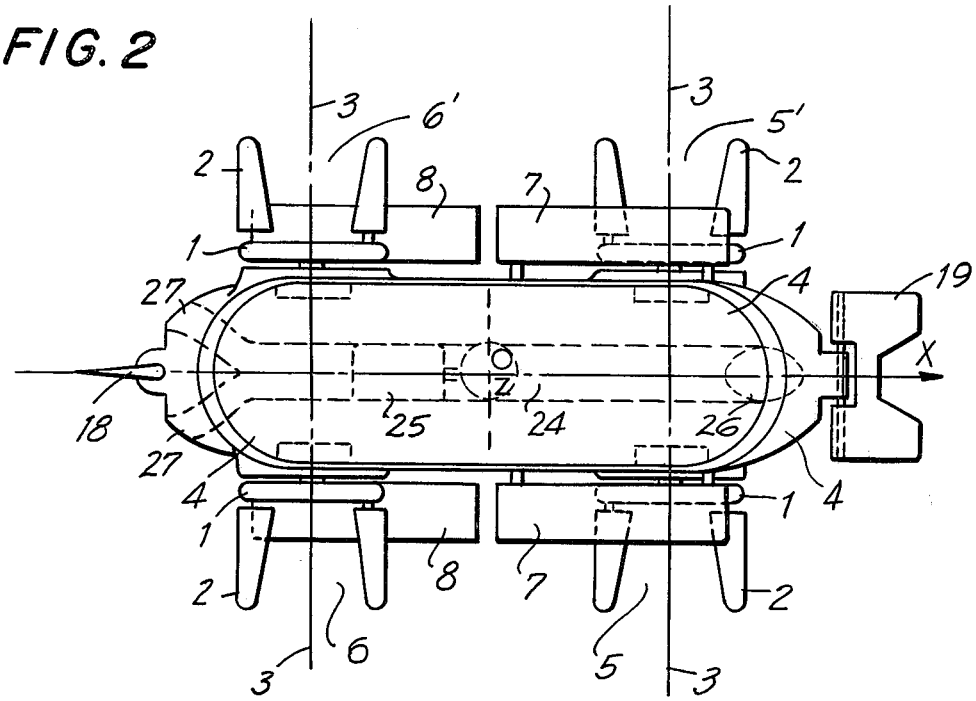
FIG. 2 is a plan view from above the aircraft of FIG. 1.

The design of the aircraft according to the present invention is mainly based on the aerial adaptation of the apparatus which is well known in the field of maritime and water navigation, under the name of "cycloidal propeller", also sometimes called "Voigth-Schneider propeller" characterized, as shown diagrammatically in FIGS. 1 and 2 by a flat ring 1, supporting at its periphery a uniform circular array of identical blades 2, each free to turn about an axis perpendicular to the ring 1 under the action of a small connecting-rod (FIG. 5) parallel to the plane of this ring, all these connecting-rods having a common control head which may be eccentric with respect to the axis of rotation 3 of the apparatus. When the position of the common head of these connecting-rods is adjusted in its degree of eccentricity under the action of a mechanical or hydraulic control operated by the pilot, the total thrust p of the apparatus always remains in the same plane perpendicular to the axis of rotation 3 and its direction may rotate at will through 360° in this plane.

By way of simplification, the aforesaid cycloidal propeller will be referred to hereafter as "V.S.A. apparatus" and it is merely shown diagrammatically in FIGS. 1 and 2.

Naturally, this adaptation to operation of such cycloidal propeller in the air will lead to considerable modifications of the features of the apparatus, in order to take into account the physical differences of the fluids handled (density, compressibility, viscosity, etc), the operation in the air of this apparatus with horizontal axes of rotation, (as, to our knowledge, in water) having had no application hitherto. For example, the propeller for an aircraft will have a greater ring diameter, a greater blade length and a greater speed of rotation than in the case of a propeller adapted for operation in water.

The following description refers to the three customary main axes of co-ordinates in space, O*x* being directed in the direction of horizontal travel of the aircraft, O*z* being the vertical at the point 0, and O*y* extending horizontally in transverse direction at point 0.

Referring to FIGS. 1 and 2, the aircraft comprises a main body or fuselage 4 having a longitudinal vertical section (through the plane *x*O*z*) of oval shape, flatter along the vertical axis O*z* and a horizontal longitudinal section (through the plane *x*O*y*) also of oval shape but more tapered along the horizontal axis O*x*. The point 0 is a general point of symmetry for the entire surface defining main body 4, i.e. this surface comprises three main planes of symmetry, viz *x*O*y*, *x*O*z* and *y*O*z*. In particular, it follows that at the time of vertical take-off or landing, the field of flow of the air around this surface, (assumed to be linear and without appendages) has the axis O*z* as an axis of symmetry and that in horizontal flight along O*x*, the field of flow of the air has axis O*x* as an axis of symmetry.

The aircraft is both lifted and propelled by four identical V.S.A. apparatuses, distributed in two pairs, one pair 5, 5' at the front, the other pair 6, 6' at the rear, all the axes of rotation of which are perpendicular to the plane *x*O*z*: the pair 5, 5' at the front and the pair 6, 6' at the rear are spaced as far apart from each other as possible and also as far away as possible from the front and rear rudders and ailerons in order to avoid any serious interaction with the latter, the two apparatuses of one pair being symmetrical with respect to this general plane of symmetry.

The axis of rotation 3 common to the two apparatuses of the front pair is located such that the upper part of each of these two apparatuses is located slightly below the plane *x*O*y*; the axis of rotation 3 of the rear pair is symmetrical with respect to the point 0 of that of the front pair such that the lower part of each of the apparatuses of the rear pair is located slightly above the plane *x*O*y*. It is the object of this arrangement to separate as clearly as possible the fields of flow of the air around the two front and rear apparatuses on each side, in order to avoid any interaction between these two apparatuses. To the same end, this arrangement is completed, on each side, by a horizontal aileron composed of segments 7, 8 located in the plane *x*O*y* and, at each of its ends, the aileron slightly extends beyond the vertical planes respectively containing the axis of rotation 3 of the front apparatus and that of the rear apparatus. The segments 7 and 8 of each aileron are substantially equal, the front part 7 (from the plane *y*O*z*) being able to be turned upwards in order to occupy a vertical position when the aircraft takes off, the rear part 8 being turned vertically downwards (the turned positions are illustrated in broken lines in FIG. 1).

All the V.S.A. apparatuses 5, 5', 6 and 6' rotate in the same direction as viewed by an observer facing the aircraft on the axis O*y*.

The distribution of mass inside the body 4 of the aircraft is provided such that the center of gravity G of the body whatever the loading condition, is always located below the center of symmetry O (FIG. 1). In particular, the present invention provides that all of the upper part of the body 4, located above the horizontal plane 9 and which no longer needs to be connected to the essential parts of the aircraft frame, could be made of light, but rigid transparent plastic material (for example lexan) in place of aluminum which is used for the construction of the parts located therebelow.

At the time of vertical take-off of the aircraft, the four V.S.A. apparatuses are regulated in order that their thrusts are at their maximum values *p*, equal to each other, all vertical in an upwards direction, each applied to the axis 3 of the corresponding apparatus and added together to give a total thrust P=4*p*, vertical in an upwards direction at the point O. This total thrust P must substantially exceed the weight $\pi$ of the aircraft which is vertical in a downwards direction at the center of gravity G of the aircraft, thus acting through O like the aerodynamic resistance in a downwards direction exerted on the aircraft. At the outset, it follows that the latter is subject to a considerably great upwards acceleration which decreases as the ascending speed and the aerodynamic resistance resulting therefrom increases.

The latter may then remain stationary at any fixed point of the trajectory followed during this vertical rise, by regulating the four V.S.A. apparatuses such that the sum of their vertical thrusts, substantially less than the maximum thrust P and always vertical at the point O alone counter-balances the weight $\pi$ of the aircraft.

In this position the aircraft may purely pivot about the vertical through its center of gravity G, i.e. around the axis Oz by increasing and inclining towards the front horizontal, the thrusts of the two apparatuses located opposite the side to which it is desired to turn the nose of the aircraft and likewise by regulating, but inclined towards the rear horizontal, the thrusts of the two apparatuses located on the other side which results in exerting on the aircraft a pure torque around a vertical axis passing through the center of gravity G, while retaining for each apparatus a total vertical component equal and opposed to $\pi$, sufficient for supporting the aircraft on the spot.

Figure 4:
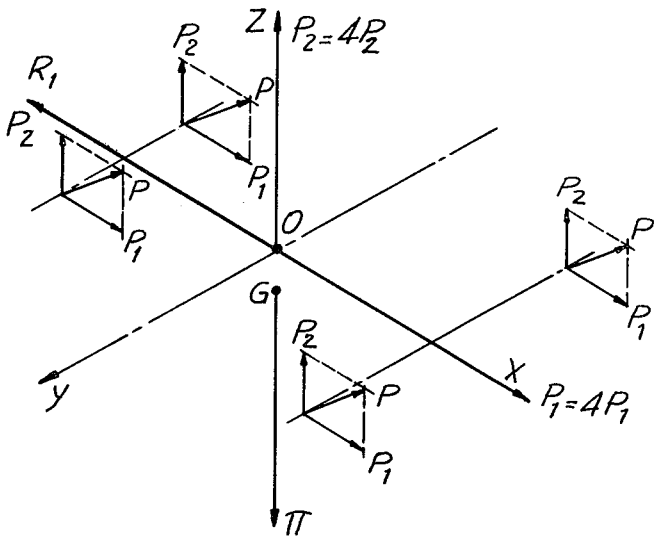
FIG. 4 is a force diagram showing the forces acting on the aircraft in horizontal flight.

Finally, with the nose of the aircraft thus located in the desired direction, the latter may commence its horizontal flight (FIG. 4) by inclining to the front horizontal, altogether, the maximum thrusts $p$ of each of the four apparatuses, which are each composed of a horizontal component $P_1$ such that $P_1=4p_1$ compensates the overall aerodynamic resistance $R_1$ of the aircraft (horizontal and passing through O) and a vertical component $P_2$ in an upwards direction such that $P_2=4p_2$ compensates the weight $\pi$ of the aircraft (in the case where the components $P_1$, $P_2$, or $R_1$ do not pass exactly through O, it would always be possible to produce a sufficient convergence of the latter at the point O by slightly differentiating the directions of the individual thrusts of the four apparatuses or by acting on the rudders and ailerons of the aircraft as will be discussed hereafter).

Naturally, the aircraft may take-off vertically, then quickly change to the position for horizontal flight without passing through the intermediate stages just described.

For steering the aircraft, the system of four V.S.A. apparatuses provides great handling facility: indeed, provided that a vertical component $P_2$ such that: $P_2=4p_2$, or at least equal to the weight $\pi$ of the aircraft is retained at any moment, for the thrust of each apparatus, in horizontal flight, it is possible to act on the magnitudes and directions of the thrusts of the four apparatuses in order to cause the following to act on the aircraft:

- a torque about the axis Ox by differentiating the vertical thrusts $p_2$ of the two apparatuses on one side with respect to the two on the other side;
- a torque about the axis Oy by differentiating the horizontal thrusts $p_1$ or vertical thrusts $p_2$ of the two front apparatuses with respect to the two rear.

However, it it is considered too complex to put these various operations of the V.S.A. apparatuses to practical use and if it is desired to retain the maximum regularity of the flight without having to modify the magnitude and direction of the equal and parallel thrusts of the four apparatuses (for example, during a cruising flight of long duration) it is possible to employ other arrangements of steering, one of which consists in providing the aircraft with conventional control surfaces i.e., a vertical rudder 18 for movement about the axis Oz and a horizontal rudder 19 for movement about the axis Oy.

Figure 3:
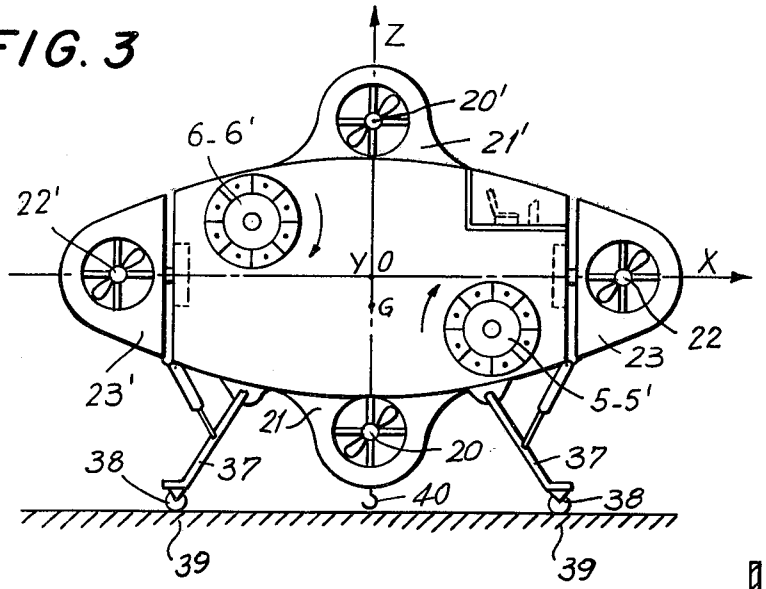
FIG. 3 is a side elevational view of an aircraft similar to that illustrated in FIG. 1 but provided with special apparatus replacing standard devices for regulating the direction of travel of the aircraft.

However, the present invention contemplates another solution as illustrated in FIG. 3:

- the torque around the axis Ox may be produced and regulated by two screws 20 and 20' having reversible blades which are rotatable about horizontal transverse axes extending parallel to the Oy axis and located on the Oz axis symmetrically with respect to O, the screws 20 and 20' being housed in the plane of two flat parts 21 and 21' connected to the body 4 of the aircraft, both disposed in the plane xOy, each screw, together with its electric drive motor, being suspended inside a circular aperture in the corresponding flat part by an appropriately stream-lined cross member connected to the frame of the flat part;
- the torque around the axis Oz may likewise be produced and regulated by two screws 22 and 22' having transverse horizontal axes extending parallel to the axis Oy with blades which are free to turn and reversible, located on the axis Ox and housed in the plane of two front and rear flat parts 23 and 23' located in the plane xOz.

This solution has the three following advantages: firstly, by directing the equal transverse thrusts of the two front and rear screws 22 and 22' in opposite directions to each other, it is possible to provide additional means for pivoting the aircraft, in the air or on the ground, about its vertical axis of symmetry Oz; secondly, by directing the thrusts of the four screws 20, 20', 22 and 22' in the same direction, it is possible to provide means (not provided by any other apparatuses which are part of the aircraft) to displace the latter, in the air or on the ground, by translation along a transverse axis parallel to the axis Oy; finally, by providing that each of the front and rear flat parts 23 and 23' is free to turn under the action of a hydraulic circular jack, about an axis coincident with the axis Ox, it is possible to give these two flat parts a horizontal position, thus to give the axes of the two corresponding screws 22 and 22' a vertical direction, which makes it possible to use them also for assisting in vertical take-off and landing of the aircraft.

Naturally, it is possible to make the steering of the aircraft automatic, according to known methods, by controlling each of the aforedescribed apparatuses, for example, by the angle which the projection on each of the three main planes of symmetry from the actual vertical makes with each of the axes of spatial coordinates Ox, Oy and Oz assumed to be connected to the aircraft, determined at any instant by a gyroscope.

The energy necessary for the operation of four V.S.A. apparatuses could be provided in several different ways, the following of which is given within the framework of the present invention as a non-limiting example.

The arrangement illustrated in FIG. 1 consists of driving by means of a gas turbine 24, a common electric generator 25, the current being distributed from the latter to the four individual motors driving the four V.S.A. apparatuses (and possibly to the four individual motors driving the four screws having transverse axes as aforementioned), for example according to the Ward-Leonard system or the Westinghouse system for railway transport. For the installation of the gas turbine 24 and the driven electric generator 25, the present invention specifically contemplates the arrangement shown in FIG. 1 wherein: the gas turbine 24 is installed in the lower part of the aircraft with its axis of rotation in the plane xOz and parallel to Ox, the air compressor being at the front, the gas turbine at the rear. The air necessary for combustion is supplied through the intake 26 located at the front lower part and having the plane xOz as its plane of symmetry, the combustion gases escaping through the two nozzles 27 located at the rear lower part and also having the plane xOz as its plane of symmetry.

Figure 5:
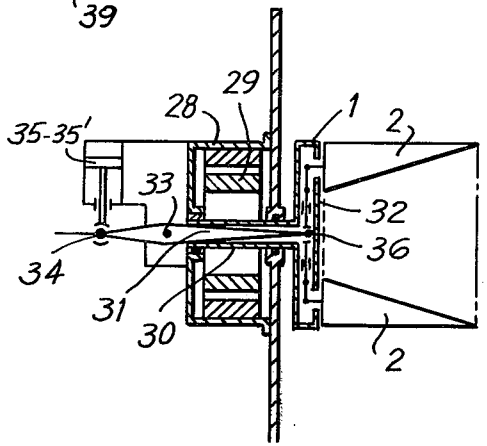
FIG. 5 is an axial horizontal section taken through one of the lift propellers.

FIG. 5 shows diagrammatically, in the case of the aircraft of FIGS. 1 and 2, the manner in which the various devices for driving one of the V.S.A. apparatuses is mounted. Therein, electric motor 28 is placed with its axis co-axial to the axis 3 of the V.S.A. apparatus. The rotor 29 of motor 28 drives the V.S.A. propeller through the intermediary of the hollow shaft 30, inside which passes a lever 31 controlling the eccentricity of the common head of the connecting-rods 32. Along its length, this lever comprises three swivel joints, the central one 33 of wich is stationary and the other two 34 and 36 are movable. The swivel joint 34 is displaced under the action of two hydraulic presses 35–35' (only one 35 of which is shown) the other mobile swivel joint 36 controlling the eccentricity of the connecting-rods 32 according to any well known kinematic arrangement, i.e. a straight lever, a pivoted lever or a conrol lever, these connecting-rods 32 all being contained inside the ring 1 and each acting on a blade 2.

It will be seen that adopting V.S.A. propellers having horizontal axes constitutes a great advantage as compared to propellers having vertical axes as have been used exclusively hitherto solely for operating in water. In particular, with the V.S.A. apparatus having a horizontal axis, the control of the orientation of the blades (while retaining the same principle of the three swivel joints) is direct and much simpler than the present customary control of apparatuses having vertical axes used (solely in water) hitherto (which requires a horizontal drive shaft from the motor, with an expensive and complicated device based on bevel gearing for modifying the direction of the shaft controlling the propeller through 90°, for making it vertical).

As a variation to the above described solution for driving the apparatuses by electric motors supplied with energy by a gas turbine driving an electric generator, the present invention provides that each of the four V.S.A. apparatuses is driven by a completely independent engine, for example by a "radial engine" or a "Wankel engine" or the like, having a horizontal axis of rotation.

FIG. 3 shows a landing gear having four retractable arms 37, symmetrical in pairs with respect to the planes $xOz$ and $yOz$ and located such that in the stationary position on the ground, a vertical line through the center of gravity of the aircraft falls at the center of the rectangle defined by the four wheels 38. These wheels are each supported to pivot about a vertical axis 39 to facilitate pivoting operations of the aircraft on land, on the spot or translational movements perpendicular to its longitudinal plane of symmetry.

The aircraft is provided with a hook 40 at its lower part, the hook being located on a vertical line passing through its center of gravity and being free to turn about a vertical axis at a fixed connection to the body of the aircraft, possibly having automatic engagement to enable it to grasp, lift, convey or deposit considerable loads on any terrain.

Figure 6:
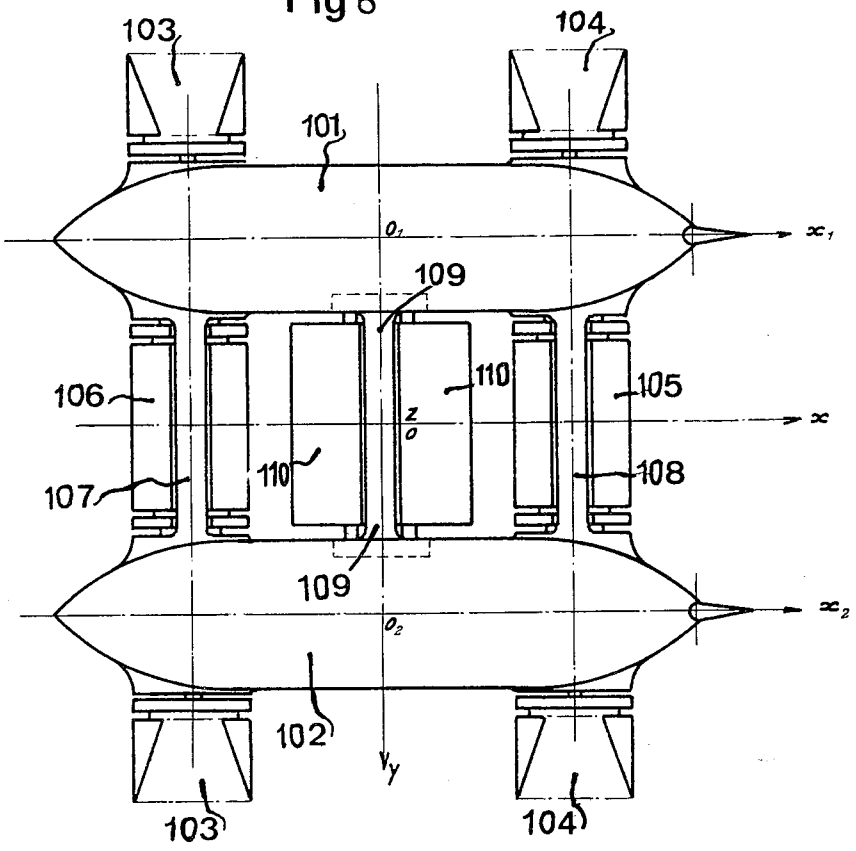
FIG. 6 is a view from above an aircraft having a double fuselage body with six propellers.

FIG. 6 is a general plan view of an aircraft constituted by a rigid connection of two aircraft bodies 101 and 102, the horizontal axes $O_1 X_1$ and $O_2 X_2$ of which are located at the same horizontal level. On each of its outer faces, each aircraft body 101 and 102 is provided with two propellers 103 and 104. The two inner propellers 105 and 106 of each of the two aircraft bodies are combined in pairs and rotate about rigid horizontal girders 107 and 108 having a circular section, each rigidly mounted at the inner faces of the bodies 101 and 102 of the aircraft, thus ensuring the connection of these two bodies. At the central part, this connection is reinforced by a rigid girder 109 having a circular section, rigidly installed, at each of its ends, in the inner central parts of the two bodies 101 and 102 of the aircraft. A co-axial mobile aileron 110 is supported for pivotable movement about girder 109, the movement of said aileron being controlled by a circular hydraulic jack located on the corresponding inner side of one of the two combined aircraft bodies.

A first advantage of the double-bodied aircraft thus produced is the possibility of providing high power, due to the multiplication of individual propeller apparatuses.

A second advantage is that two identical gas turbines, each housed in the lower part of each of the combined aircraft bodies, may serve mutually as replacements for providing energy to all the propellers.

Figure 7:
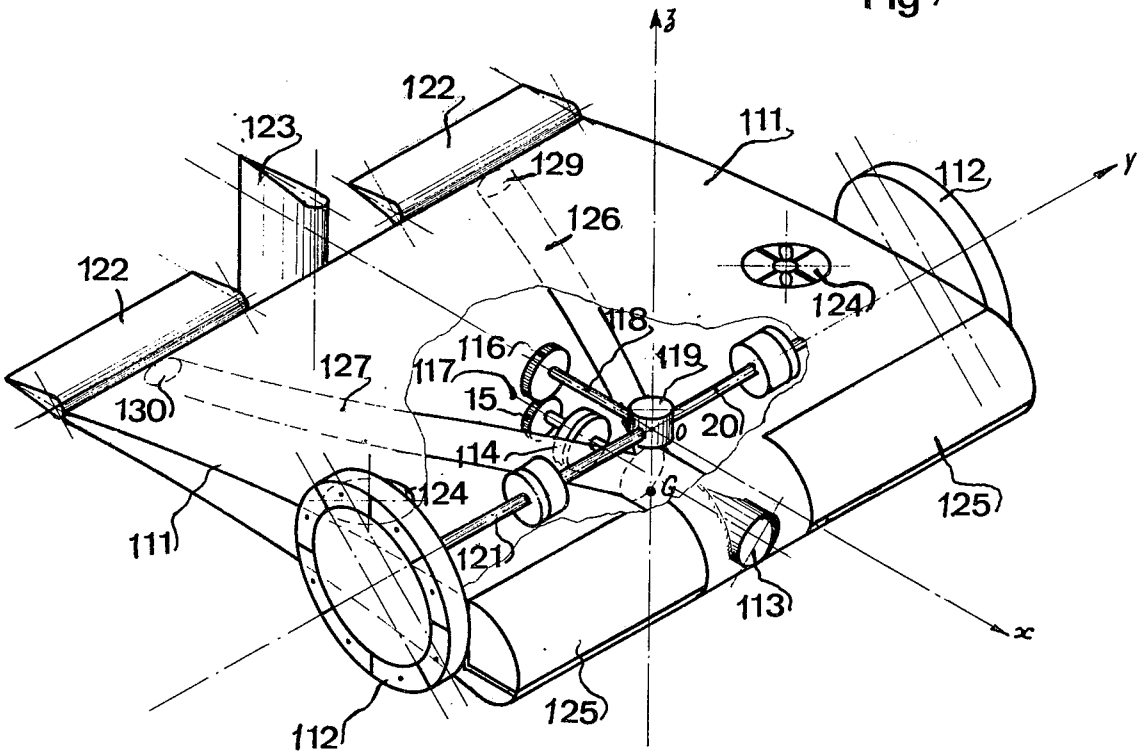
FIG. 7 is a diagrammatic perspective view, partly broken away, of the apparatus for driving an aircraft having two propellers, driven by a gas turbine with various mechanisms for driving the two lateral propellers which are symmetrical with respect to the general vertical plane of symmetry of the aircraft and, (when stationary) located at the same horizontal level.

FIG. 7 shows another type of aircraft in which the outer casing (aircraft body 111) is broken away to give a clearer illustration of the drive means and the auxiliary parts for connecting the two lateral propellers 112, located at the same horizontal level.

Figure 8:
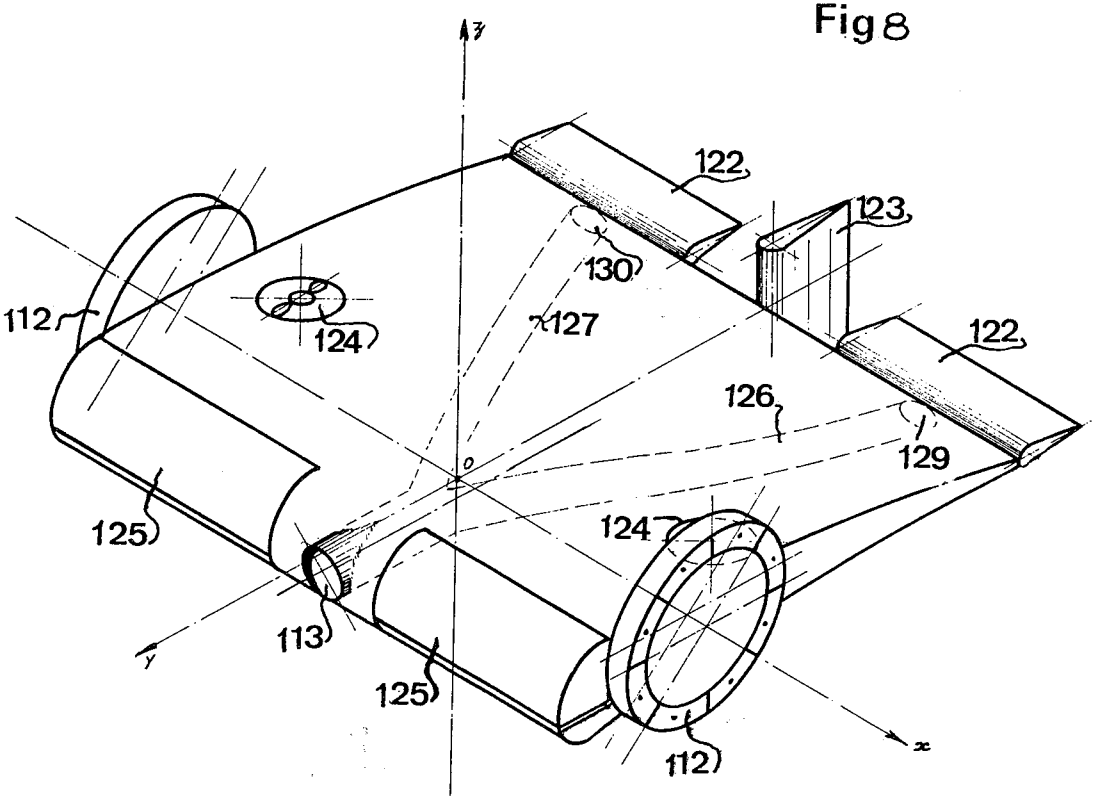
FIG. 8 is a diagrammatic view, in perspective, of an aircraft of the "flying wing" type.

FIG. 7 shows diagrammatically the mechanisms for driving the two propellers of this new aircraft, while FIG. 8 merely shows the same in a general diagrammatic perspective view.

The aircraft of FIGS. 7 and 8 is equipped with a gas turbine 113 whose axis is located slightly below the plane $xOy$, with its compressor at the front and its turbine at the rear. By means of an automatic, hydrokinetic clutch 114 (for example a "Hydramatic" transmission of the type manufactured by General Motors), the rear output shaft of the gas turbine drives a gearing having two pinions (115 for the small one, 116 for the larger located thereabove) in a common plane and perpendicular to the output shaft 117 of the turbine. The shaft 118 of the large upper wheel 116 of this gearing is coincident with the axis $Ox$ and extends forwardly to drive a differential 119, similar to that provided in the drive wheels of the motor vehicle. From this differential, (substantially at the center O) on each side, extend two shafts 120 and 121 both on the axis $Oy$; by means of an automatic hydro-kinetic clutch, each of these shafts drives one of the two cycloidal lateral propellers 112, the rings of which are parallel to the plane $xOz$.

The aircraft thus described constitutes a genuine "flying wing". It is also very interesting due to the arrangement of the series of mechanisms which, from the gas turbine, drive the two lateral propellers 112 which may be applied to aircraft of other types (possibly by replacing the gas turbine 113 by another type of engine inside the body of the aircraft), for example those described with reference to FIGS. 1, 2 and 6.

The inherent lift of this "flying wing" is such that it makes it possible to relieve the two lateral propellers 112 to a greater or lesser extent of the lift function, the full power of wich propellers may thus be consequently devoted to forward propulsion. Despite this "flying wing" characteristic, this aircraft, may also be considered as a "vertical take-off aircraft" owing to the two cycloidal propellers with which it is equipped and the thrust of which may be firstly directed upwards or downwards so that it is devoted entirely to take-off or landing.

Moreover, both on land as in the air, this aircraft is capable of pivoting in place about the axis Oz, by causing the drive of one of the lateral propellers 112 to be exactly opposed to the other.

The qualities of maneuverability of the aircraft above described (FIGS. 5 and 7) may be improved as follows:

for movement about the axis O*y* it is possible to provide a horizontal rudder 122 over the entire width of the rear part of the flying wing parallel to the axis O*y;* for movements about the axis O*y*, a vertical rudder 123 may be provided, in the plane *x*O*z*, immediately at the rear of the flying wing;

for movements about the axis O*x*, there can be provided symmetrically with respect to this axis O*x*, two screw-propellers having blades which are free to turn and with a vertical axis 124, located as far as possible from the plane *x*O*z* on each side of the wing, the pipes for supplying and discharging air to and from these two screw-propellers passing through the wing vertically on either side.

This aircraft may comprise two pilot cabins 125, located on either side of the plane *x*O*z*, symmetrical to each other with respect to this plane, these cabins being housed inside the "flying wing" and at the front end of the latter to provide optimum visibility.

Finally, the exhaust gases of the gas turbine may be discharged into two pipes 126 and 127, symmetrical with respect to the plane *x*O*z* and which extend inside the inner volume of the "flying wing" and discharge at open, rear ends 129 and 130.

Figure 9:
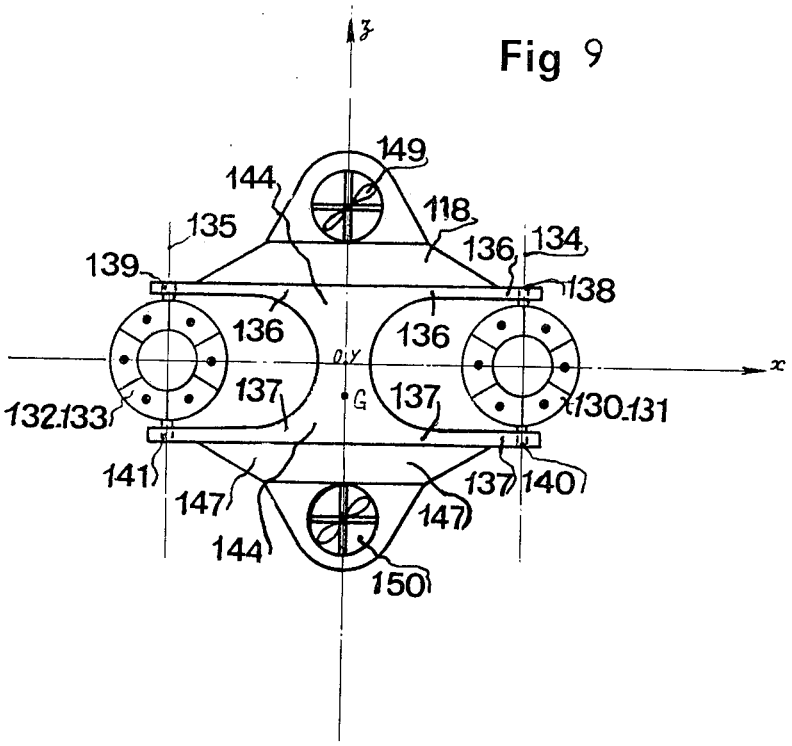
FIG. 9 is a side elevational view which shows an aircraft having four propellers divided into two groups of independent propellers, free to turn about axes parallel to the axis Oz and symmetrical with respect to the latter, mounted on a simple metal frame, two screw-propellers having blades free to turn about axes perpendicular to the plane xoz and symmetrical with respect to the axis Ox.

FIG. 9 is a general diagrammatic front view of an aircraft, provided with four independent propellers which are free to turn, in which the emphasis is placed on lightness (total elimination of the outer casing), low mass, maneuverability and safety. The propellers 130 and 131, on the one hand, and 132 and 133 on the other hand, are free to turn about vertical axes 134 and 135, the turning power being provided by two circular jacks (not shown, having the same axes 134 and 135) the four propellers being placed between the two horizontal girders 136 and 137. The propellers pivot in vertical bearings 138 and 139 in upper girders 136 and in bearings 140 and 141 in the lower girders 137.

The engines 142 and 143 on the one hand, and 145 and 146 on the other hand are respectively concentric with the propellers 130–131 and 132–133 to which they are rigidly and directly connected. These engines, which are totally independent, may be of the "radial" or "Wankel" type. The thickness of the arrangement of the vertical girder 144 supporting the four propellers in pairs is as minimum as permitted by general strength requirements and the internal central part of this girder may be advantageously used as a fuel tank 147. A pilot's cabin 148, surrounded with plexiglass over its entire periphery, is located immediately above the girder 136.

Figure 10:
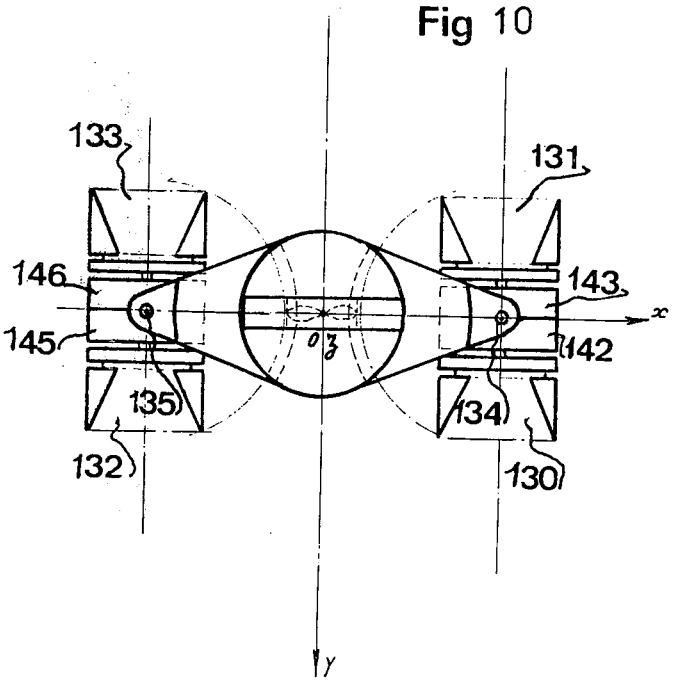
FIG. 10 is a diagrammatic horizontal section of the aircraft of FIG. 9.

FIG. 10, which is a diagrammatic horizontal section of the aircraft, shows, in particular, how the arrangement of the two propellers 130 and 131 on the one hand and 132 and 133 on the other hand, may pivot about axes 134 and 135 such that the corresponding thrusts may be directed in all directions both in the *x*O*y* plane as well as in the *x*O*z* plane and how this arrangement makes it possible to provide exceptional maneuverability.

As may be seen, this aircraft comprises four independent propellers, grouped in pairs: propellers 130 and 131 on the one hand, and 132 and 133 on the other hand, each group being able to pivot about one of the axes 134 or 135. This arrangement makes it possible to improve the safety of the aircraft: in fact, if the unitary powers of each of these propellers are provided such that two of these four propellers (one on each side and symmetrical with respect to O) are sufficient to support the aircraft, the failure of any one of these propellers is without serious consequences for the safety of the aircraft.

In order to perfect the movements of the aircraft about the axis, O*x*, it is possible to provide, at the upper and lower ends of this aircraft, two screw-propellers having blades 149, which are free to turn, for the upper part, 150 for the lower part, the axes of which are directed along axes parallel to O*y* when stationary.

It should also be noted that this type of light aircraft facilitates either "vertical take-off" or pivoting in place on the ground or in the air by consequently regulating (by rotating them about vertical axes 134 and 135) the directions of the horizontal axes of each of the two groups of propellers 130 and 131 on the one hand, and 132 and 133 on the other hand, by varying the direction of their thrusts.

One advantage of this type of aircraft is that its weight is reduced to a minimum, which makes it particularly suitable, for example, for equipping a ship carrying helicopters.

FIGS. 11 and 12 show an aircraft whose outer casing is of elongated cylindrical shape and is continuous having the axis O*x* as its axis of symmetry.

Propulsion is ensured by eight propellers, four distributed on each side of the aircraft: on the one hand, the group of so-called "central" propellers 151 and 152 having transverse axes, respectively symmetrical with respect to the point O, and on the other hand, the group of so-called "extreme" propellers 153 and 154, still remaining symmetrical with respect to the point O.

The aircraft is provided with a hollow internal shell 155 (FIG. 11) extending from the rear to the front of the aircraft, with transverse separating partitions. Inside this internal shell are housed freight, equipment, provision, fuel etc.

The inside of the aircraft is separated longitudinally by rigid transverse frames, firstly to make the aircraft assembly more rigid and secondly to divide the latter into several compartments.

The unitary power of each propeller, (all of which are identical to each other) is such that the sum of their vertical drive forces makes it possible, at least to lift the total weight of the aircraft, including that of the freight, equipment, provisions fuel etc.

To simplify construction and inspection, it is preferable to provide eight individual propellers as lateral propellers, each driven by an independent engine ("radial" engine or "Wankel" engine, as in previous known type of aircraft) but it is also possible to adopt a method for driving each pair of propellers (one on each side) by a gas turbine T located slightly below their common axis and using the succession of mechanisms already described with respect to FIG. 7.

The maneuverability of the aircraft may be advantageously completed by two screw-propellers 156 and 157 having blades which are free to turn and which propellers are housed respectively at the front and rear ends on the axis O*x*, with their axes perpendicular to the plane *x*O*z* in order to supplement the rotation of the aircraft about the axis O*z*.

Since the aircraft is an "amphidrome", two pilot's cabins 158 and 159 are provided, located symmetrically with respect to the axis Oz in the upper part of the aircraft, one at the front, the other at the rear in order to have clear vision.

For resting on the ground, the aircraft is provided with three solid supports 160 and 161 at each end and 162 at the central part. To ensure softer contact between the aircraft and the ground, these stands may be constituted by thick pheumatic chambers inflated with air for landing. Several series of retractable lateral shoes 163 and 164 may be provided, when stationary, for assisting the aircraft in resisting the force of cross winds on the shell of the aircraft (FIG. 12).

At the lower part, FIG. 13 illustrates an inert aircraft, i.e. one which is not provided with propellers. This aircraft is filled with a light gas, for example, helium, between the inner and outer shells, the volume occupied by this light gas having the effect of lifting the aircraft arrangement and its freight, equipment, provisions and fuel etc.

The transport of this inert aircraft is effected by a separate and powerful auxiliary aircraft located at the upper part of FIG. 13 (for example of the type shown in FIG. 1) and which has a platform 165 at its lower part, corresponding to a similar platform on the main body of the lower inert aircraft, the separate and powerful auxiliary aircraft being able to be placed on the upper stand of the aerial vessel, to which it is connected very rigidly for example by a series of strong bolts for clamping together two lateral lips 166 and 167 which the platforms of each aircraft are provided. The clamping of these bolts is effected by several rigid cables 168 fixed to the lower platform and whose clamping is ensured by corresponding strong latch arrangments 169 or in a variation by quick operating hydraulic hooks 170 as seen in FIG. 13*a*.

Since the weight of the freight of the lower inert aircraft, its equipment and provisions is virtually compensated by the upward thrust ensured by the gas contained between the inner and outer envelopes, almost all the propulsion means of the upper auxiliary towing member may be devoted to the various maneuvers in space of the assembly constituted by the connection of the inert vessel and the towing aircraft.

In particular, this assembly may take off vertically and pivot about the axis Oz, exactly like the towing aircraft itself.

One of the considerable advantages of this connection between an inert airship ("aerial vessel") and a towing arrangement is the saving in investment costs. Namely, one or two towing aircraft can operate a shuttle service between a greater number of inert airships and for the same reason, a saving in overall time for the complete transportation of a predetermined cargo can be obtained as one of the inert "aerial vessels" can be loaded while another is flying or being unloaded at the same time.

What is claimed is:

1. An aircraft comprising a fuselage body constructed and arranged for propulsion in air, said body being substantially symmetrical and having vertical and horizontal longitudinal planes, and an integrated lift, propulsion and steering system including four cycloidal propellers grouped in pairs on said fuselage body, one pair at the front and one pair at the rear of the body, each cycloidal propeller having a horizontal axis of rotation and comprising a flat ring having a horizontal axis, a circular array of identical horizontal blades, each free to turn about an axis perpendicular to said ring, said blades being supported from said ring at the periphery thereof, connectingrods extending parallel to the plane of said ring and coupled to the blades for turning the same to vary the angle of net thrust produced by the blades, and a common control head coupled to said connecting rods to operate the same and which may be eccentrically adjusted with respect to the axis of rotation of said propeller to vary the angle of thrust produced by said propeller within a vertical plane, said two pairs of cycloidal propellers being symmetrical with respect to the center of symmetry of the aircraft, the front pair being below the horizontal plane of symmetry, the rear pair above said plane, the two propellers of the same pair being co-axial and symmetrical with respect to the longitudinal vertical plane of symmetry, the propellers all rotating in the same direction, a system of four auxiliary screws having blades which are free to turn and reversible, with an axis perpendicular to the longitudinal vertical plane of symmetry, said fuselage body including four flat parts, two on the longitudinal horizontal axis of symmetry at the front and at the rear and two on the transverse vertical axis of symmetry, at the top and bottom of the aircraft, stream-lined cross members mounted in said flat parts and suspending the screws therein, the two front and rear screws and the flat parts associated therewith being supported for rotation through 90° about a horizontal longitudinal axis to make the thrusts of the two corresponding screws vertical for take-off and landing operations.

2. An aircraft as claimed in claim 1, in which the four propellers can be regulated to give four vertical thrusts which are equal and in the same direction for take-off and landing of the aircraft or four thrusts which are equal and in the same direction, inclined towards the horizontal, for horizontal cruising flight, the resultant of these four thrusts exactly counterbalancing the resultant of the aerodynamic forces exerted on the aircraft due to its flight, the resultant of the thrusts of the four propellers and those of the aerodynamic forces being applied at a point located substantially at the center point of symmetry of the fuselage body.

3. An aircraft as claimed in claim 1 comprising a landing gear including four feet which can be retracted when in flight, said feet being arranged symmetrically in pairs with respect to the longitudinal and transverse vertical planes of symmetry of the body, at least one wheel supported by each foot, for rolling on the ground about a horizontal axis and also for pivoting movement about a vertical axis to facilitate pivoting in place or translation movement of the aircraft parallel to itself.

4. An aircraft as claimed in claim 1 comprising a hook supported from said body at the lower surface thereof on a vertical line through the center of gravity, said hook being rotatable about a vertical axis and securely connected to said body to enable it to grasp, lift, convey or deposit loads.

5. An aircraft as claimed in claim 1 comprising a pilot's cabin housed in said fuselage body at the front end part thereof so as to be confined within the outer contour of said body.

6. An aircraft as claimed in claim 1 comprising hook means on said fuselage body for securing an inert craft thereon.

7. An aircraft as claimed in claim 6 wherein the inert craft includes an upper rigid horizontal platform adapted for being detachably secured to said hook means.

8. An aircraft as claimed in claim 7 wherein the inert craft includes screw propellers.

9. An aircraft as claimed in claim 1 comprising an individual electric drive motor for each of the four propellers and the four auxiliary screws, each of said individual motors having a horizontal output shaft, said motors being mounted inside said body, a common generator for all of said motors and a gas turbine having a horizontal axis parallel to the longitudinal axis of the body and located in a bottom portion of said body, said turbine being drivingly coupled to the generator, said turbine including an air compressor which has a lower front air inlet and a lower rear nozzle in the shape of a Y for discharge of exhaust gases.

10. An aircraft comprising a fuselage body constructed and arranged for propulsion in air, said body being substantially symmetrical and having vertical and horizontal longitudinal planes, and an integrated lift, propulsion and steering system including four cycloidal propellers grouped in pair on said fuselage body, one pair at the front and one pair at the rear of the body, each cycloidal propeller having a horizontal axis of rotation and comprising a flat ring having a horizontal axis, a circular array of identical horizontal blades, each free to turn about an axis perpendicular to said ring, said blades being supported from said ring at the periphery thereof, connectingrods extending parallel to the plane of said ring and coupled to the blades for turning the same to vary the angle of net thrust produced by the blades, a common control head coupled to said connecting rods to operate the same and which may be eccentrically adjusted with respect to the axis of rotation of said propeller to vary the angle of thrust produced by said propeller within a vertical plane, and a hollow drive shaft for driving each propeller, said control head including means for swivelling the connecting-rods of the propeller, comprising a control lever passing inside said hollow shaft, a central swivel joint for said control lever which is stationary, two movable swivel joints at the end of the lever and two stationary hydraulic cylinders disposed at 90° with respect to each other coupled to the inner of the movable swivel joints.

* * * * *